US007741781B2

(12) United States Patent
Nagayama et al.

(10) Patent No.: US 7,741,781 B2
(45) Date of Patent: Jun. 22, 2010

(54) RADIO-FREQUENCY ACCELERATING CAVITY AND CIRCULAR ACCELERATOR

(75) Inventors: Takahisa Nagayama, Tokyo (JP); Nobuyuki Zumoto, Tokyo (JP); Yoshihiro Ishi, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 946 days.

(21) Appl. No.: 11/452,999

(22) Filed: Jun. 15, 2006

(65) Prior Publication Data

US 2007/0051897 A1 Mar. 8, 2007

(30) Foreign Application Priority Data

Sep. 8, 2005 (JP) ..... 2005-260112

(51) Int. Cl.
*H01J 3/14* (2006.01)

(52) U.S. Cl. ..... 315/5.41; 315/5.42; 315/501

(58) Field of Classification Search ..... 315/4, 315/5, 5.13, 5.34, 5.41–5.43, 500–502, 111.41, 315/111.61; 313/62; 250/396 R, 423 R, 250/492.21

See application file for complete search history.

(56) References Cited

U.S. PATENT DOCUMENTS 3,174,278 A * 3/1965 Barger et al. ..... 60/202
4,712,042 A * 12/1987 Hamm ..... 315/5.41
4,801,847 A * 1/1989 Sakudo et al. ..... 315/5.41
5,917,293 A 6/1999 Saito et al.
6,713,976 B1 * 3/2004 Zumoto et al. ..... 315/500
7,196,337 B2 * 3/2007 Mikolas ..... 250/423 R

FOREIGN PATENT DOCUMENTS

| | | |
|---|---|---|
| JP | 61-150204 | 7/1986 |
| JP | 63-193499 | 8/1988 |
| JP | 03-245499 | 11/1991 |
| JP | 7-6900 | 1/1995 |
| JP | 7-161500 | 6/1995 |
| JP | 09-161997 | 6/1997 |
| JP | 2000-077200 | 3/2000 |
| JP | 2001-126900 | 5/2001 |

OTHER PUBLICATIONS

Notice of Reasons for Rejection in JP 2005-260112 dated Mar. 31, 2009, and an English Translation thereof.

* cited by examiner

*Primary Examiner*—Douglas W Owens
*Assistant Examiner*—Jimmy T Vu
(74) *Attorney, Agent, or Firm*—Buchanan Ingersoll & Rooney PC

(57) ABSTRACT

An RF accelerating cavity includes an accelerating cavity unit and an inductance varying device having a magnetic member connected parallel to an acceleration electrode gap. The RF accelerating cavity is tuned in such a fashion that a charged particle beam acceleration frequency matches a resonant frequency of the RF accelerating cavity by regulating inductance of the inductance varying device in accordance with a changing pattern of the charged particle beam acceleration frequency. Alternatively, impedance of the RF accelerating cavity is increased with the provision of a fixed inductance connected parallel to the acceleration electrode gap when the RF accelerating cavity has a narrow acceleration frequency range.

15 Claims, 13 Drawing Sheets

RADIO-FREQUENCY ACCELERATING CAVITY AND CIRCULAR ACCELERATOR

BACKGROUND OF THE INVENTION

1. Field of the Invention

The present invention relates to a radio-frequency (RF) accelerating cavity used in a charged-particle accelerator and a circular accelerator employing the RF accelerating cavity.

2. Description of the Background Art

Tuned RF accelerating cavities and untuned RF accelerating cavities are well-known examples of RF accelerating cavities used in a circular accelerator for accelerating electrically charged particles. To accelerate ions in an ion synchrotron using such an RF accelerating cavity, for example, an RF electric field whose frequency increases must be applied to the RF accelerating cavity fed from a RF power source to keep in step with the orbiting frequency of the ions.

A tuned RF accelerating cavity generates an accelerating voltage necessary for accelerating ions such that the resonant frequency of the cavity increases in synchronism with the frequency applied by the RF power source. In contrast, an untuned RF accelerating cavity is configured such that the impedance of the cavity is increased to necessary values in a full range of acceleration frequencies in advance.

There exist conventionally known techniques for controlling the resonant frequency of an RF accelerating cavity by the applied frequency in a predefined sequence. For example, Japanese Laid-open Patent Application No. 1995-006900 describes a tuned RF accelerating cavity which is structured such that ferrite members whose permeability has a large imaginary part are mounted in the RF accelerating cavity to decrease Q-value (or the ratio of a frequency range of resonance to a center frequency of resonance) of the RF accelerating cavity, and a bias coil for generating a magnetic field produced by the ferrite members is mounted in the cavity. In this structure, a real part of the permeability of the ferrite members is varied by the strength of a magnetic field produced by the bias coil to control the resonant frequency of an electromagnetic field excited in the RF accelerating cavity.

On the other hand, Japanese Laid-open Patent Application No. 1995-161500 describes an untuned RF accelerating cavity which is structured such that ferrite members having a large amount of Joule loss are mounted in the RF accelerating cavity to increase the impedance of the cavity by the ferrite members and a plurality of parallel shunt resistors are provided in the RF accelerating cavity. In this structure, the shunt resistors are switched in such a way that the shunt resistor having a large resistance value is connected to the ferrite members in a frequency range where the resistance value Zferr of the ferrite members is small and the shunt resistor having a small resistance value is connected to the ferrite members in a frequency range where the resistance value Zferr of the ferrite members is large, so that the RF accelerating cavity has a constant impedance throughout an acceleration frequency range thereof.

Also, Japanese Laid-open Patent Application No. 2001-126900 describes an untuned RF accelerating cavity which is structured such that an acceleration core made of ferrite is split into a plurality of segments cut by a plane containing a central axis of the acceleration core in order to decrease beam loading effects (or effects an ion beam exerts on the RF accelerating cavity) for uniformly accelerating the ion beam.

However, the aforementioned RF accelerating cavity of Japanese Laid-open Patent Application No. 1995-006900 has a problem that it is impossible to apply a high-intensity magnetic field as it is necessary to apply a direct current (DC) bias to the ferrite members and operate the RF accelerating cavity in the proximity of saturated magnetic field level of the ferrite members. Additionally, this RF accelerating cavity has a problem that the ferrite members can not be provided with any arrangement for cooling so that the inductance of the ferrite members is susceptible to temperature increase, making it difficult to control the RF accelerating cavity in a stable fashion.

In the aforementioned RF accelerating cavity of Japanese Laid-open Patent Application No. 1995-161500, it is necessary to set a resonance point in a range of acceleration frequencies, so that this RF accelerating cavity has a problem that it is impossible to set the impedance of an acceleration core at a desired point and sufficiently increase the impedance of the RF accelerating cavity.

Also, the aforementioned RF accelerating cavity of Japanese Laid-open Patent Application No. 2001-126900 has such problems as a cost increase due to the need for cutting the acceleration core into separate segments and heat generation caused by concentration of magnetic field at cut surfaces of the core segments particularly when the cavity is a large-core type.

SUMMARY OF THE INVENTION

Intended to overcome the aforementioned problems of the prior art, the present invention has as an object the provision of a high-impedance RF accelerating cavity provided with inductance or an inductance varying device connected parallel to an acceleration electrode gap formed in a cavity unit, wherein inductance synthetically produced by an acceleration core and a magnetic member of the inductance varying device and capacitance produced by the acceleration electrode gap together resonate. The invention has as another object the provision of a circular accelerator employing such an RF accelerating cavity.

According to the invention, an RF accelerating cavity includes an accelerating cavity unit having an acceleration electrode gap for generating an RF electric field for accelerating a charged particle beam and an acceleration core forming a magnetic path surrounding an orbit of the charged particle beam, and an inductance varying device of which magnetic member is connected parallel to the acceleration electrode gap, wherein inductance produced by the inductance varying device is varied in accordance with a changing pattern of a charged particle beam acceleration frequency to tune the RF accelerating cavity such that the charged particle beam acceleration frequency matches a resonant frequency of the RF accelerating cavity.

Since this RF accelerating cavity of the invention is tuned such that the charged particle beam acceleration frequency matches the resonant frequency of the RF accelerating cavity by varying the inductance produced by the inductance varying device of which magnetic member is connected parallel to the acceleration electrode gap, it is possible to increase impedance of the accelerating cavity and relax conditions to be satisfied by the acceleration core. It will be appreciated that the invention is advantageous in that the RF accelerating cavity can be tuned with a simple structure.

A typical example of application of the invention is an RF accelerating cavity of a circular accelerator which accelerates and accumulates electrically charged particles.

These and other objects, features and advantages of the invention will become more apparent upon reading the following detailed description along with the accompanying drawings.

DESCRIPTION OF THE PREFERRED EMBODIMENTS

To facilitate understanding of the structures and principle of operation of RF accelerating cavities of the present invention, the working of a conventional RF accelerating cavity including an acceleration core and an acceleration electrode gap is first described with reference to FIGS. 12A to 12C.

Figure 12A:
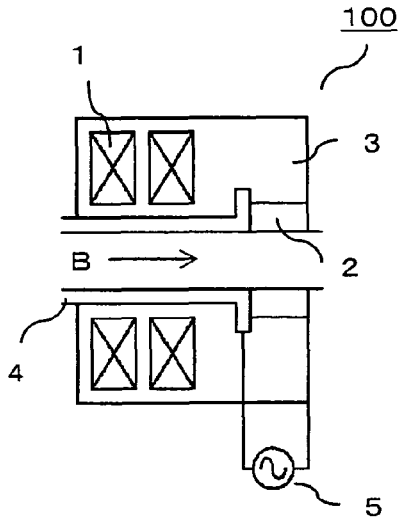
FIGS. 12A, 12B and 12C are a schematic diagram and equivalent circuits of a conventional RF accelerating cavity.

FIG. 12A is a schematic diagram showing the structure of a conventional RF accelerating cavity 100 which includes an acceleration core 1, an acceleration electrode gap 2, an outside cavity wall 3, a vacuum duct 4 and an RF power supply 5. The RF accelerating cavity 100 thus structured which is driven in a frequency range at around a few megahertz operates at relatively long wavelengths compared with cavity size, so that the operation of the RF accelerating cavity 100 can be mostly analyzed by using an electric circuit model. FIG. 12B is a mathematical model, or an equivalent circuit, of the RF accelerating cavity 100, in which a combination of series-connected inductance Xs and resistance Rs represents the acceleration core 1 provided in the RF accelerating cavity 100 and capacitance C represents the acceleration electrode gap 2. The acceleration core 1 has the resistance Rs because excitation of the acceleration core 1 causes heat generation (core loss) therein which is expressed by resistance in a circuit. Using complex permeability μ (whose real part is μ' and imaginary part is μ"), impedance Z of the acceleration core 1 including the core loss is expressed by equation (1) below:

$$Z=i\omega\mu L_0=i\omega\mu' L_0+\omega\mu'' L_0=i\omega Ls+Rs=iXs+Rs \tag{1}$$

where ω is angular frequency (ω=2πf when acceleration frequency is f), $L_0$ is an inductance component of the acceleration core 1, Rs is a resistance component of the acceleration core 1, and iXs is an imaginary part of the impedance Z of the acceleration core 1.

Figure 12B:
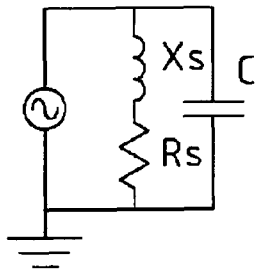
Figure 12C:
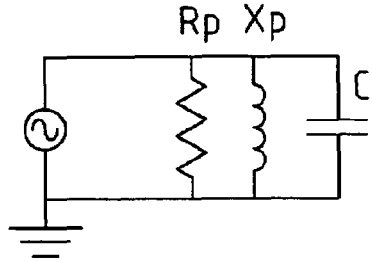

While the acceleration core 1 of the RF accelerating cavity 100 is represented by the combination of the series-connected inductance Xs and resistance Rs in the model shown in FIG. 12B, the acceleration core 1 can also be represented by a combination of an inductance component Xp (=ωLp) and a resistance component Rp which are connected parallel to each other as shown in FIG. 12C. The inductance component Xp and the resistance component Rp can be expressed by using Xs and Rs as indicated by equations (2a) and (2b) below, which are obtained by assuming that the impedance Z of the acceleration core 1 expressed by the series-connected inductance and resistance components Xs, Rs is equal to that expressed by the parallel-connected inductance and resistance components Xp, Rp:

$$\omega Lp = Xp = \frac{Rs^2 + Xs^2}{Xs} \tag{2a}$$

$$Rp = \frac{Rs^2 + Xs^2}{Rs} = 2\pi \cdot \mu_P Qf \cdot L_0 \tag{2b}$$

$$\left[\mu_P = \frac{\mu'^2 + \mu''^2}{\mu'}\right]$$

Rp in equation (2b) above is a quantity referred to as a shunt impedance. As is apparent from equation (3) shown below, this quantity is impedance obtained when impedance Zc of the RF accelerating cavity 100 becomes infinite under conditions where inductance of the RF accelerating cavity 100 and the capacitance C of the acceleration electrode gap 2 connected in parallel with each other together resonate. Indicated by $\mu_p$Qf in equation (2a) above, which is commonly used for expressing RF accelerating cavity property, is a quantity characteristic of an acceleration core material (i.e., shunt resistance value, or Q-value). The larger this quantity, the larger the impedance that can be obtained. The impedance Zc of the RF accelerating cavity 100 including the capacitance C of the acceleration electrode gap 2 is expressed by using Lp and Rp as indicated by equation (3) below:

$$|Zc| = \frac{1}{\sqrt{\frac{1}{Rp^2} + \left(\frac{1}{\omega Lp} - \omega C\right)^2}} \tag{3}$$

where |Zc| is the absolute value of the impedance Zc of the RF accelerating cavity 100.

Electric power P necessary for obtaining a specific acceleration voltage V (peak value) is given by equation (4) below:

$$P = \frac{V^2}{2|Zc|} \tag{4}$$

Power consumption of the RF accelerating cavity 100 can be reduced by increasing the absolute value of the impedance Zc thereof. One method of increasing the absolute value |Zc| is to vary the inductance such that a condition of resonance (1/ωLp=ωC) is satisfied within an acceleration frequency range as in the earlier-mentioned tuned RF accelerating cavity of Japanese Laid-open Patent Application No. 1995-006900.

On the other hand, if the first term of the denominator of the right side of equation (3) is sufficiently larger than the second term thereof, the value |Zc| does not decrease even if the RF accelerating cavity deviates from the condition of resonance a little. This means that if the value of Rp is made relatively small compared to the value of Xp (=ωLp), no practical problem occurs even if the RF accelerating cavity is not set to satisfy the condition of resonance as in the earlier-mentioned untuned RF accelerating cavities of Japanese Laid-open Patent Application Nos. 1995-161500 and 2001-126900. This relationship can be expressed by using Q-value of the acceleration core 1 as indicated by equation (5) below:

$$Q = \frac{\mu'}{\mu''} = \frac{Xs}{Rs} = \frac{Rp}{Xp} = \frac{f_0}{\Delta f} \tag{5}$$

where $f_0$ is resonant frequency of the RF accelerating cavity 100, Δf is half-power width (or a frequency range between points at which the value of $|Zc|^2$ is one-half a peak value thereof). It is possible to configure an untuned RF accelerating cavity if a material having a small Q-value is used in the acceleration core 1.

Problems of the earlier-mentioned conventional RF accelerating cavities are discussed below based on the foregoing description.

An untuned RF accelerating cavity whose acceleration core is a magnetic alloy core using an amorphous laminated alloy film, for example, is characterized by such a property that shunt impedance (loss-producing resistance) thereof does not deteriorate even at a magnetic flux density exceeding 1000 gauss. It is however difficult to increase the shunt impedance of this kind of untuned RF accelerating cavity to a level of several hundred ohms.

In contrast, a tuned RF accelerating cavity having a ferrite core has a problem that the same can achieve a little improvement in shunt impedance and a maximum value of accelerating voltage that can be applied is so low compared with the untuned RF accelerating cavity as will be later discussed in detail.

The two problems of the conventional RF accelerating cavities are considered with reference to specific examples of the tuned RF accelerating cavity employing a ferrite core whose Q-value is 20 (Q=20) and the untuned RF accelerating cavity employing a magnetic alloy core whose Q-value is 0.5 (Q=0.5).

Here, it is assumed that these RF accelerating cavities have a resonant frequency of 3 MHz and the capacitance C of the acceleration electrode gap 2 shown in FIG. 12A is 50, 100 or 200 pF. Shown in Table 1 below are calculated results of characteristics of the magnetic alloy and ferrite core cavities.

TABLE 1

Characteristics of RF Accelerating cavities with Different Core Materials

| Magnetic Alloy Core Cavity (w/laminated alloy film) | | | Q 0.5 Δf 6 | Ferrite Core cavity | | | Q 20 Δf 0.15 |
|---|---|---|---|---|---|---|---|
| C (pF) | 50 | 100 | 200 | C (pF) | 50 | 100 | 200 |
| Xp (Ω) | 1,061 | 531 | 265 | Xp (Ω) | 1,061 | 531 | 265 |
| Rp (Ω) | 531 | 265 | 133 | Rp (Ω) | 21,220 | 10,620 | 5,300 |

Firstly, the characteristics of the untuned RF accelerating cavity employing the magnetic alloy core are examined. Since the magnetic alloy core has a small Q-value, the half-power width Δf of the untuned RF accelerating cavity is large (Δf=6 MHz from equation (5)). The acceleration frequency range of this RF accelerating cavity (which is assumed to be between 2 and 4 MHz) lies within the half-power width Δf, so that the magnetic alloy core has an impedance whose value is approximately 80% of a peak impedance value throughout an entire range of acceleration frequencies in the aforementioned example of calculation. On the other hand, if the resonant frequency of the cavity and the capacitance C of the acceleration electrode gap 2 are known, the values of Xp and Rp (=Q·Xp) are uniquely determined. As it is difficult to decrease the capacitance C of the acceleration electrode gap 2 to 50 pF or less, it is recognized that the impedance of this RF accelerating cavity 100 can not be easily increased to a level of several hundred ohms.

Secondly, the characteristics of the tuned RF accelerating cavity employing the ferrite core are examined. While different ferrite core materials can have much varying Q-values, it is assumed that the acceleration core 1 used in this RF accelerating cavity 100 has a Q-value is 20 (Q=20) in the present example. Although the acceleration core 1 used in this example has so high a Q-value that the half-power width Δf of the RF accelerating cavity 100 is only 1/40 (0.15 MHz), it is possible to increase the impedance of this RF accelerating cavity 100 to a level 40 times higher than that of the RF accelerating cavity 100 employing the magnetic alloy core. Thus, it should be possible to significantly reduce power consumption with this RF accelerating cavity 100 employing the ferrite core.

In actuality, however, this kind of RF accelerating cavity 100 mostly employs a ferrite core whose Q-value is about 1, so that the impedance of the RF accelerating cavity 100 can not be increased so much. A major reason for this is that it is difficult to control the inductance of a ferrite material and, if a ferrite core having a high Q-value (which scarcely functions as a core other than at the resonant frequency) is used, it is impossible to control the RF accelerating cavity 100 in a stable manner. This problem is explained in further detail below.

A method of varying the inductance of the acceleration core (ferrite core) 1 used in the conventional tuned RF accelerating cavity 100 is to vary the permeability of the ferrite core by superimposing a DC magnetic field. This method is described with reference to FIG. 13 which is a B-H curve of a ferrite material, in which no consideration is given to hysteresis for the sake of simplicity.

Figure 13:
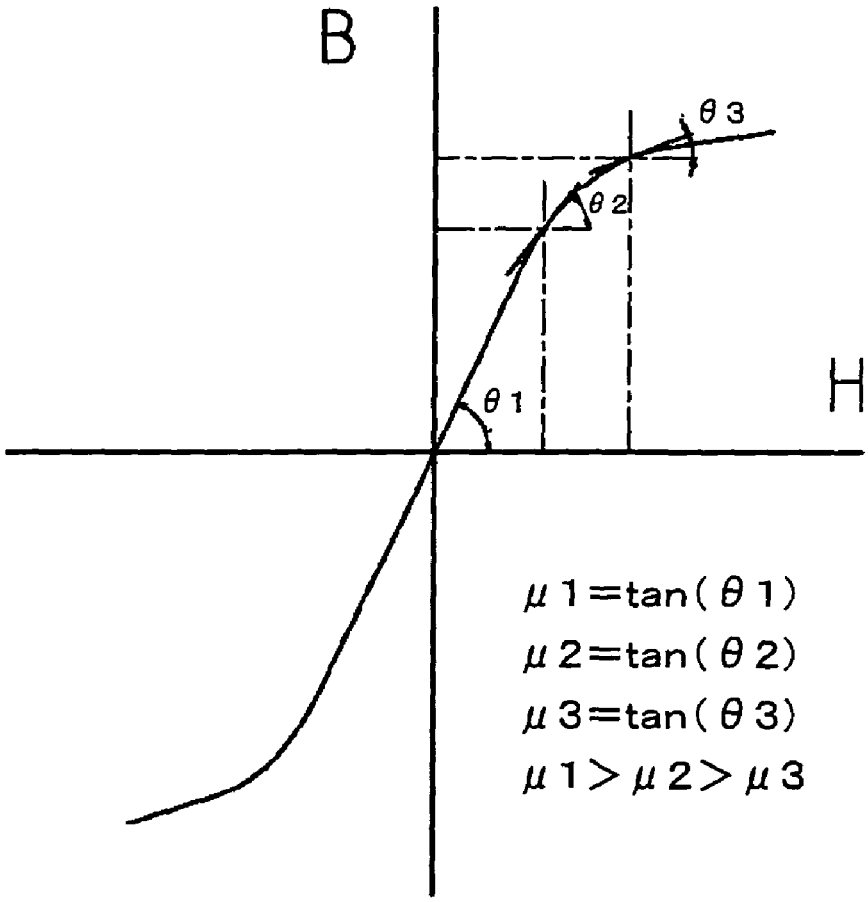
FIG. 13 is a B-H curve of ferrite.

Permeability μ is obtained from B=μH, where B is magnetic flux density within a core and H is magnetomotive force which is proportional to a current linked to the core. Initial permeability (or permeability in the proximity of the graph origin) of the core is therefore $\mu_1=\tan(\theta_1)$ as depicted in FIG. 13. In regions where the value of H is high (high field strength), the core tends to saturate and the gradient of the B-H curve decreases. Permeability $\mu_q$ of the ferrite core at a point q is expressed by $\mu_q=\tan(\theta_q)$. This property of the ferrite core can be used for varying the permeability thereof. As already mentioned, however, the RF accelerating cavity 100 using this approach has a problem that its operation is unstable and the accelerating voltage that can be applied is too low.

A reason why the operation of the RF accelerating cavity 100 employing the ferrite core is unstable is as follows. Generally, the Curie temperature of ferrite is low and B-H characteristics of ferrite are apt to vary with temperature. Especially because the tuned RF accelerating cavity 100 of the aforementioned conventional structure produces a condition of resonance by controlling the value of a differential of the B-H curve (i.e., permeability), instability of the B-H characteristics is increased. Additionally, this type of RF accelerating cavity 100 has a problem that the temperature of the acceleration core 1 increases due to heat generation by the acceleration core 1 itself until thermal equilibrium is reached when the RF accelerating cavity 100 is operated. This makes it difficult to control the RF accelerating cavity 100.

Due to such poor controllability, the conventional tuned RF accelerating cavity 100 makes it necessary to assume a large error in matching the acceleration frequency to the resonant frequency of the RF accelerating cavity 100. This means that it is generally desired for the acceleration core 1 of the tuned RF accelerating cavity 100 to have a low Q-value so that the impedance the acceleration core 1 would not change so much even if the acceleration frequency and the resonant frequency are unmatched. Accordingly, the acceleration core 1 of the conventional tuned RF accelerating cavity 100 mostly uses a ferrite material of which Q-value is about 1 or less.

With this level of the Q-value, however, it is impossible to produce high-impedance RF accelerating cavities like those shown in Table 1. For this reason, a mainstream tendency today is the untuned RF accelerating cavity of which acceleration core 1 uses a magnetic alloy material featuring thermal stability and a wide operating range.

A reason why the accelerating voltage applicable to the RF accelerating cavity 100 employing the ferrite core is low is as follows. The acceleration voltage V generated across the acceleration electrode gap 2 is the product of a change dB/dt in magnetic flux density within the acceleration core 1 produced by a high-frequency current and the cross-sectional area S of the acceleration core 1. This means that the larger the change in the magnetic flux density within the acceleration core 1 produced by the high-frequency current, the higher the acceleration voltage obtained.

Typically, the operating range of the acceleration core 1 is approximately 70% to 90% of a saturation flux density Bs of the acceleration core 1. Thus, to obtain a high acceleration voltage, it is desirable to operate the acceleration core 1 on both sides of the origin of the graph of FIG. 13.

However, since the permeability of the acceleration core 1 is varied by superimposing a DC magnetic field in this method of varying the inductance of the acceleration core 1, the operating range of the acceleration core 1 is significantly narrowed to (Bs−Bq), where Bq is the value of the magnetic flux density B at the aforementioned point q.

Nevertheless, it is necessary to increase the cross-sectional area S of the acceleration core 1 to obtain a specified accelerating voltage level, and as a result, the tuned RF accelerating cavity 100 increases in size.

It should be obvious from the foregoing discussion that the conventional tuned RF accelerating cavity 100 has various inconveniences as the inductance of the acceleration core 1 is varied by superimposing the DC magnetic field.

The present invention is intended to overcome the aforementioned problems of the conventional RF accelerating cavities by providing novel tuned RF accelerating cavities of which structure and operation are described in the following with reference to the appended drawings in which elements identical or similar to those shown in FIGS. 12A, 12B and 12C are designated by the same reference numerals.

First Embodiment

Figure 1A:
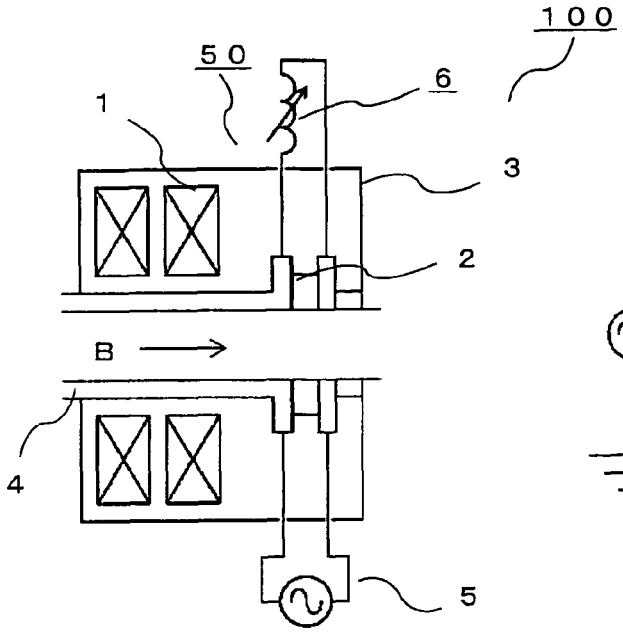
FIGS. 1A and 1B are a schematic diagram and an equivalent circuit showing the structure of an RF accelerating cavity according to a first embodiment of the invention.

An RF accelerating cavity 100 according to a first embodiment of the invention is now described with reference to FIGS. 1A, 1B, 2, 3A and 3B. As shown in FIG. 1A, the RF accelerating cavity 100 includes an accelerating cavity unit 50 having an acceleration core 1, an acceleration electrode gap 2, an outside cavity wall 3 and a vacuum duct 4, as well as an RF power supply 5 provided on the outside of the accelerating cavity unit 50 and an inductance varying device 6 having a core member disposed parallel to the acceleration electrode gap 2. A charged particle beam B is supposed to proceed from left to right as illustrated by an arrow in FIG. 1A.

Figure 1B:
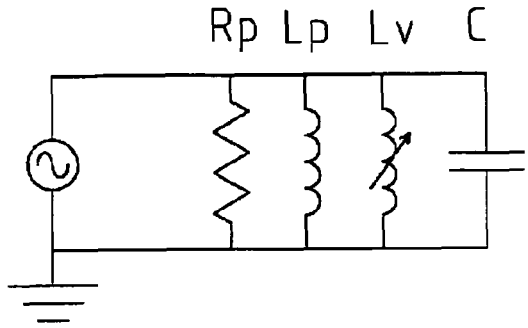

FIG. 1B is a mathematical model, or an equivalent circuit, of the RF accelerating cavity 100 expressed by a parallel circuit configuration. Referring to FIG. 1B, designated by Rp is a resistance component of the acceleration core 1, or a shunt impedance, designated by Lp is an inductance component of the acceleration core 1, designated by Lv is inductance of the inductance varying device 6, and designated by C is capacitance of the acceleration electrode gap 2.

The RF accelerating cavity 100 of the present embodiment includes the inductance varying device 6 which works as inductance for tuning connected parallel to the acceleration electrode gap 2 in addition to the inductance component Lp of the acceleration core 1. This configuration makes it possible to operate the RF accelerating cavity 100 under properly tuned conditions by varying the inductance of the inductance varying device 6.

Now, the working of the inductance varying device 6 is explained, focusing in particular on the roles of the acceleration core 1 and an unillustrated core of the inductance varying device 6.

The acceleration core 1 installed in the accelerating cavity unit 50 is a medium through which alternating current (AC) magnetic flux passes for generating an induction electric field in the acceleration electrode gap 2. The AC magnetic flux generated by the acceleration core 1 must be linked with the charged particle beam B. This means that the magnetic flux generated in the core linked with the charged particle beam B produces an electric field for accelerating the charged particle beam B. If inductance of the accelerating cavity unit 50 is varied by using the inductance varying device 6, it is not necessary to vary the permeability of the core 1, so that the core 1 can be used throughout a full operating range from zero flux to saturated magnetic field density. As a consequence, a sufficiently wide operating range can be obtained even with a core material of which saturated magnetic flux density is relatively low, and it follows that limitations on the choice of the core material of the acceleration core 1 are significantly lessened.

On the other hand, the inductance varying device 6 serves to adjust the frequency of LC resonance which is determined by the capacitance C of the acceleration electrode gap 2 and inductance L produced by the inductance Lp of the acceleration core 1 and the inductance Lv of the inductance varying device 6, and does not contribute to accelerating the charged particle beam B. It is therefore preferable to prevent a reduction in the impedance of the accelerating cavity unit 50 by using a core material having a high Q-value. Also, as it is not necessary for the inductance varying device 6 to be linked with the charged particle beam B, various methods can be used for varying the inductance Lv of the inductance varying device 6. Furthermore, as it is possible to freely determine the shape of the core of the inductance varying device 6 as well as the number of turns of an unillustrated coil of the inductance varying device 6, limitations on the choice of the core material of the inductance varying device 6 are significantly lessened.

When the inductance varying device 6 is connected parallel to the acceleration electrode gap 2 of the accelerating cavity unit 50 as described above, it is possible to increase the impedance of the accelerating cavity unit 50 and significantly relax conditions to be satisfied by the core materials of the acceleration core 1 and the inductance varying device 6.

The foregoing discussion has revealed an improvement of characteristics achieved by the RF accelerating cavity 100 provided with the parallel-connected inductance varying device 6. The structure of the inductance varying device 6 is now described with reference to a specific example thereof depicted in FIGS. 2A and 2B. There are generally two types of inductance-varying methods; a method of varying reluctance and a method of varying core permeability. The former method is to vary a gap of a gapped core, for example, whereas the latter corresponds to a method of varying a biasing magnetic field as previously shown in the description of the background art. The example shown in FIGS. 2A and 2B is an arrangement for varying reluctance.

Figures 2A, 2B:
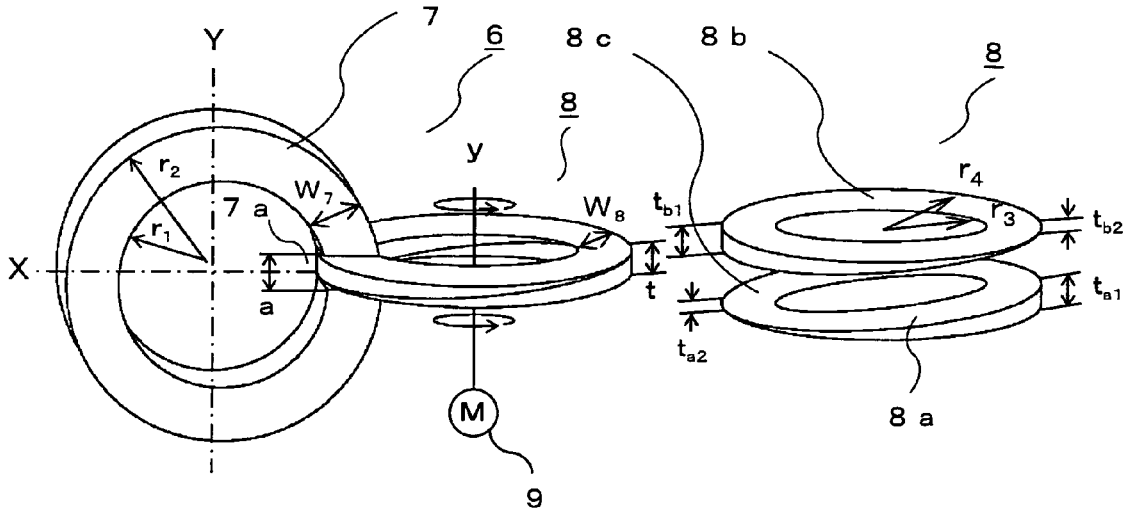
FIGS. 2A and 2B are diagrams showing a specific configuration of an inductance varying device used in the accelerating cavity of the first embodiment.

FIGS. 2A and 2B are diagrams showing a specific configuration of the inductance varying device 6 shown in FIG. 1. The inductance varying device 6 includes a toroidal core 7, a flat toroidal magnetic member 8 and a turning mechanism 9 for controllably turning the flat toroidal magnetic member 8 as illustrated. The toroidal core 7 is provided with a coil (now shown) and made of a magnetic material, such as ferrite. Having an inner radius $r_1$ and an outer radius $r_2$, the toroidal core 7 is radially cut in one angular direction to form a radial gap 7*a* having a gap length "a" as shown in FIG. 2A. The flat toroidal magnetic member 8 is generally doughnut-shaped and has an inner radius $r_3$ and an outer radius $r_4$. The flat toroidal magnetic member 8 includes a toroidal magnetic element 8*a* made of a magnetic material, such as ferrite, which exhibits a low eddy current loss and high $\mu_p$Qf-value and a toroidal nonmagnetic element 8*b* made of a ceramic material, the toroidal magnetic element 8*a* and the toroidal nonmagnetic element 8*b* being bonded to each other on tapered facing surfaces 8*c* formed thereon with a specific angle of inclination. As depicted in FIG. 2B, the toroidal magnetic element 8*a* has a maximum thickness $t_{a1}$ at a thick portion and a minimum thickness $t_{a2}$ at a thin portion, whereas the toroidal nonmagnetic element 8*b* has a maximum thickness $t_{b1}$ at a thick portion and a minimum $t_{b2}$ at a thin portion. Thus, the thickness t of the flat toroidal magnetic member 8 is given by $t=t_{a1}+t_{b2}$ or $t=t_{a2}+t_{b1}$.

The thickness t of the flat toroidal magnetic member 8 is smaller than the gap length "a" of the gap 7*a* in the toroidal core 7. As illustrated in FIG. 2A, the toroidal core 7 and the flat toroidal magnetic member 8 are arranged such that a Y-axis of the toroidal core 7 is parallel to a y-axis of the flat toroidal magnetic member 8 which is turned by the turning mechanism 9 including a motor, for example. The toroidal core 7 has a radial width $W_7$ ($=r_2-r_1$) while the flat toroidal magnetic member 8 has a radial width $W_8$ ($=r_4-r_3$). There is a relationship expressed by $W_7=W_8$, $W_7>W_8$ or $W_7<W_8$ between the radial width $W_7$ of the toroidal core 7 and the radial width $W_8$ of the flat toroidal magnetic member 8. As the toroidal magnetic element 8*a* and the toroidal nonmagnetic element 8*b* are tapered as mentioned above, the elements 8*a*, 8*b* of the flat toroidal magnetic member 8 would generate heat at their sharpest portions. Excessive heat generation at the sharpest portions of the elements 8*a*, 8*b* can however be almost prevented as the flat toroidal magnetic member 8 is cooled when rotated by the turning mechanism 9.

The aforementioned method of varying the reluctance is explained in detail. First, inductance of a gapless toroidal core used as a basis in applying this reluctance-varying method is determined. Average magnetic path length m of the toroidal core having the outer radius $r_2$, reluctance Rm and inductance L of a doughnut-shaped core wound by N turns of a wire of a coil are expressed by equations (6a), (6b) and (6c) below, respectively:

$$m=\pi(r_1+r_2) \tag{6a}$$

$$Rm\approx m/\mu_r\mu_0 S \tag{6b}$$

$$L=N^2/Rm \tag{6c}$$

where m is average length of a path of magnetic flux passing in the core, $\mu_r$ is relative permeability of the core and $\mu_0$ is permeability of a vacuum.

Next, inductance of the toroidal core when the toroidal core is cut to form a radial gap having a gap length "a" is determined. Reluctance Rmg of the toroidal core with the radial gap is calculated as indicated by equations (7a), (7b) and (7c) below:

$$R_{mg}=\frac{a}{\mu_0 S}+\frac{m-a}{\mu_r\mu_0 S}=\frac{a}{\mu_0 S}\left(\frac{\frac{m}{a}-1}{\mu_r}+1\right) \tag{7a}$$

$$R_{mg}\approx\frac{a}{\mu_0 S} \qquad \left(\frac{m}{a}<<\mu_r\right) \tag{7b}$$

$$R_{mg}\approx\frac{m}{\mu_r\mu_0 S} \qquad \left(\frac{m}{a}>>\mu_r\right) \tag{7c}$$

When an unillustrated controller causes the turning mechanism 9 to turn the flat toroidal magnetic member 8 through the gap 7*a* in the toroidal core 7 as shown in FIG. 2A, distances between cut ends of the toroidal core 7 and top and bottom faces of the toroidal magnetic element 8*a* continuously vary, whereby the reluctance Rmg varies accordingly and, as a consequence, the toroidal core 7 and the flat toroidal magnetic member 8 together act as a variable inductance. The RF accelerating cavity 100 installed in a circular accelerator like an ion synchrotron, for instance, can be tuned in accordance with a changing pattern of a charged particle beam acceleration frequency if the motor of the turning mechanism 9 for turning the flat toroidal magnetic member 8 is controllably run to vary the shape (thickness) of the toroidal magnetic element 8*a* relative to the toroidal core 7 such that the inductance of the inductance varying device 6 varies in the same pattern as the acceleration frequency changing pattern. The toroidal nonmagnetic element 8*b*, which serves as a weight balancer for balancing the rotating flat toroidal magnetic member 8 in one aspect, may have approximately the same weight as the toroidal magnetic element 8*a*. If the rotating flat toroidal magnetic member 8 is to be balanced more strictly, the flat toroidal magnetic member 8 may be structured such that the toroidal nonmagnetic element 8*b* has a slightly greater weight than the toroidal magnetic element 8*a* and holes are made in the toroidal nonmagnetic element 8*b*, for instance, to finely adjust the balance of the flat toroidal magnetic member 8.

Figure 3A:
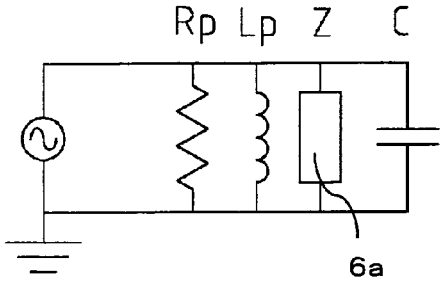
FIGS. 3A and 3B are equivalent circuits showing how the inductance varying device is connected in the accelerating cavity in variations of the first embodiment.
Figure 3B:
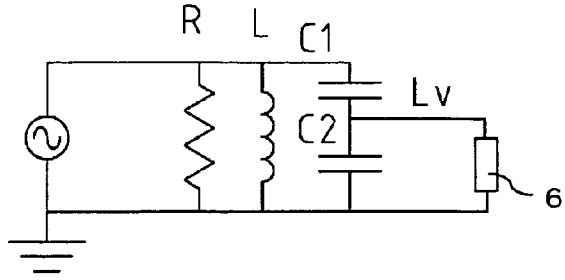

While the first embodiment of the invention has been discussed with reference to the specific example in which the inductance varying device (variable inductance) 6 is connected parallel to the capacitance C of the acceleration electrode gap 2, impedance having a variable inductance component may be connected parallel to the capacitance C of the acceleration electrode gap 2 in one variation of the first embodiment as shown in FIG. 3A, yet exploiting the same advantageous effect as the first embodiment. Alternatively, the first embodiment may be modified such that an electrode plate is inserted in the acceleration electrode gap 2 shown in FIG. 1A to divide the capacitance C thereof into two capacitances $C_1$, $C_2$ and the inductance Lv of the inductance varying device 6 or impedance Z is connected parallel to part ($C_1$ or $C_2$) of the capacitance C as shown in FIG. 3B.

Furthermore, although the flat toroidal magnetic member 8 is configured by joining the toroidal magnetic element 8*a* and the toroidal nonmagnetic element 8*b* into a single structure with the tapered facing surfaces 8*c* thereof bonded face to face, bonded surfaces need not necessarily be tapered surfaces but may be stepped surfaces. Still alternatively, while the accelerating cavity unit 50 has only one acceleration electrode gap 2 in the first embodiment, the RF accelerating cavity 100 may be modified such that the accelerating cavity unit 50 has two or more acceleration electrode gaps.

Second Embodiment

A second embodiment of the invention also employs a method of varying inductance by varying reluctance as in the above-described example of the first embodiment. The method of varying the inductance and a configuration for carrying out the method of the second embodiment are described with reference to FIG. 4. In the configuration of this embodiment, an initially doughnut-shaped core of an inductance varying device 6*a* is spit into two halves, wherein one of the two halves is kept stationary and the other is made rotatable so that a gap between magnetic poles (magnetic pole gap) can be varied by turning the latter half of the core.

Figure 4:
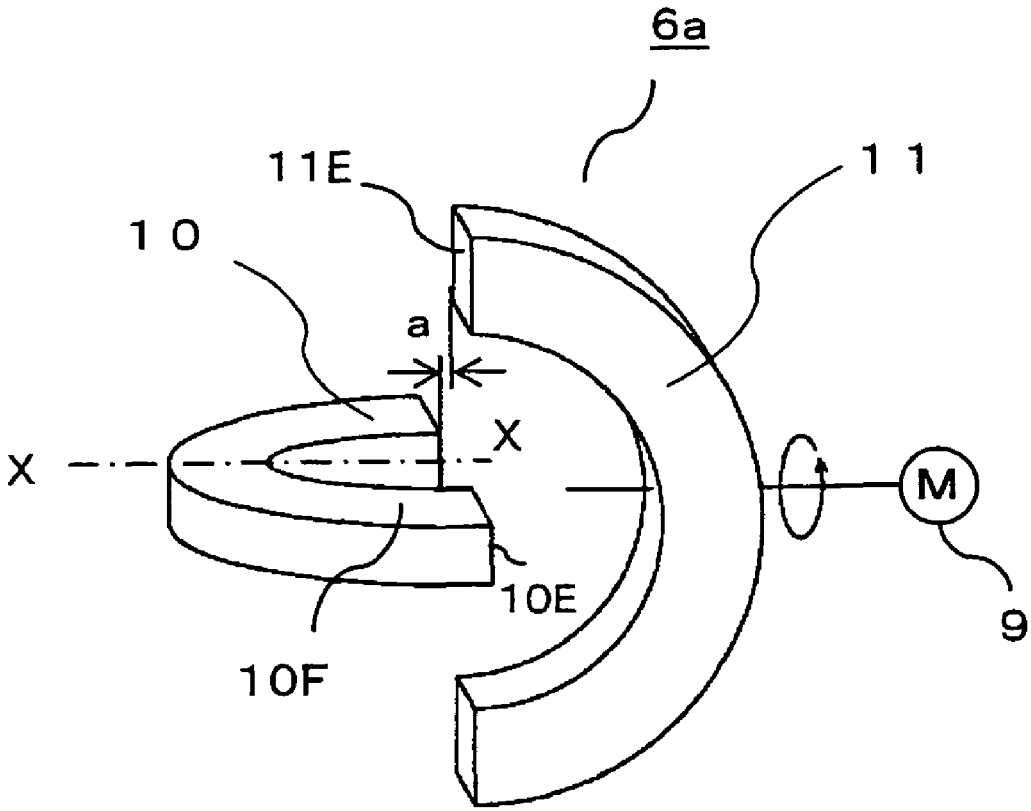
FIG. 4 is a schematic diagram of an inductance varying device according to a second embodiment of the invention.

Referring to FIG. 4, the stationary half of the core made of a magnetic material is hereinafter referred to as a stationary semicircular toroidal core member 10 while the rotatable half of the core is hereinafter referred to as a rotatable semicircular toroidal core member 11, wherein a coil wound on the core is not illustrated. The rotatable semicircular toroidal core member 11 is made rotatable relative to the stationary semicircular toroidal core member 10 about a common axis X-X passing through central points of the two core members 10, 11. The inductance varying device 6*a* of this embodiment includes the stationary semicircular toroidal core member 10, the rotatable semicircular toroidal core member 11 and a turning mechanism 9 for controllably turning the rotatable semicircular toroidal core member 11. The aforementioned magnetic pole gap having a gap length "a" separates end faces 10E of the stationary semicircular toroidal core member 10 from end faces 11E of the rotatable semicircular toroidal core member 11.

In the inductance varying device 6*a* of the embodiment thus structured, the gap length "a" of the magnetic pole gap between the stationary semicircular toroidal core member 10 and the rotatable semicircular toroidal core member 11 can be varied to a great extent. This makes it possible to satisfy a condition of equation (7b) (i.e., $m/a \ll \mu_r$) even if the half-split core of the inductance varying device 6*a* is made of a ferrite material, for example, of which relative permeability $\mu_r$ is relatively low.

To obtain a desirably shaped acceleration frequency changing pattern (inductance changing pattern) with the inductance varying device 6*a* thus structured, it is preferable to mount a proper magnetic pole shim on each longitudinal end surface 10F of the stationary semicircular toroidal core member 10.

While the rotatable semicircular toroidal core member 11 is supported by a rotary shaft oriented with its axis horizontal as illustrated in FIG. 4, the rotatable semicircular toroidal core member 11 can be turned more smoothly if the rotary shaft is vertically oriented (preferably with the rotatable semicircular toroidal core member 11 suspended) since no bending stress occurs in the rotary shaft.

Figure 5:
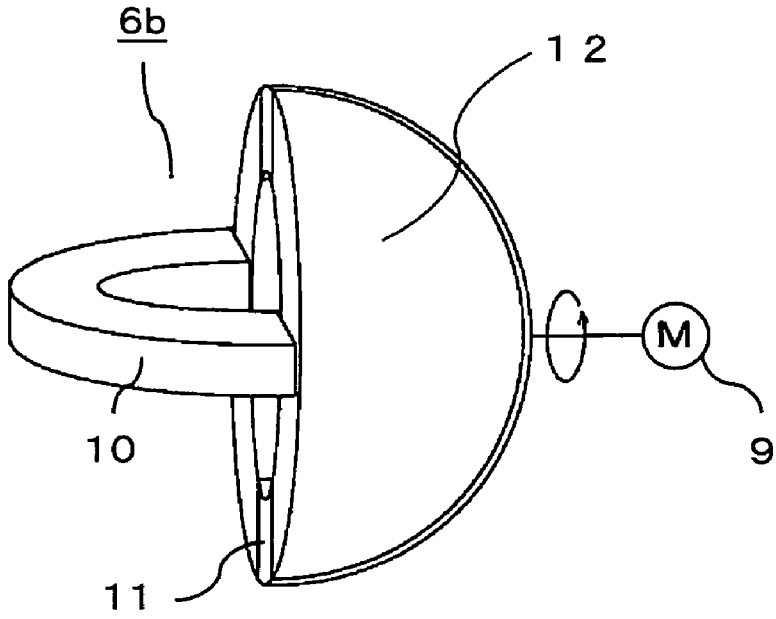
FIG. 5 is a schematic diagram of an inductance varying device in one variation of the second embodiment of the invention.

FIG. 5 is a schematic diagram showing an inductance varying device 6*b* in one variation of the second embodiment. As illustrated in FIG. 5, the inductance varying device 6*b* includes a stationary semicircular toroidal core member 10, a rotatable semicircular toroidal core member 11, a turning mechanism 9 and a nonmagnetic hemispherical weight balancer 12 made of a ceramic material, for instance, the nonmagnetic hemispherical weight balancer 12 having a rotationally symmetric shape to entirely cover the rotatable semicircular toroidal core member 11. The inductance varying device 6*b* thus structured can be turned smoothly compared to the above-described inductance varying device 6*a* due to an improvement in weight balance during rotation of the rotatable semicircular toroidal core member 11 and a reduction in air resistance.

Third Embodiment

Figure 6:
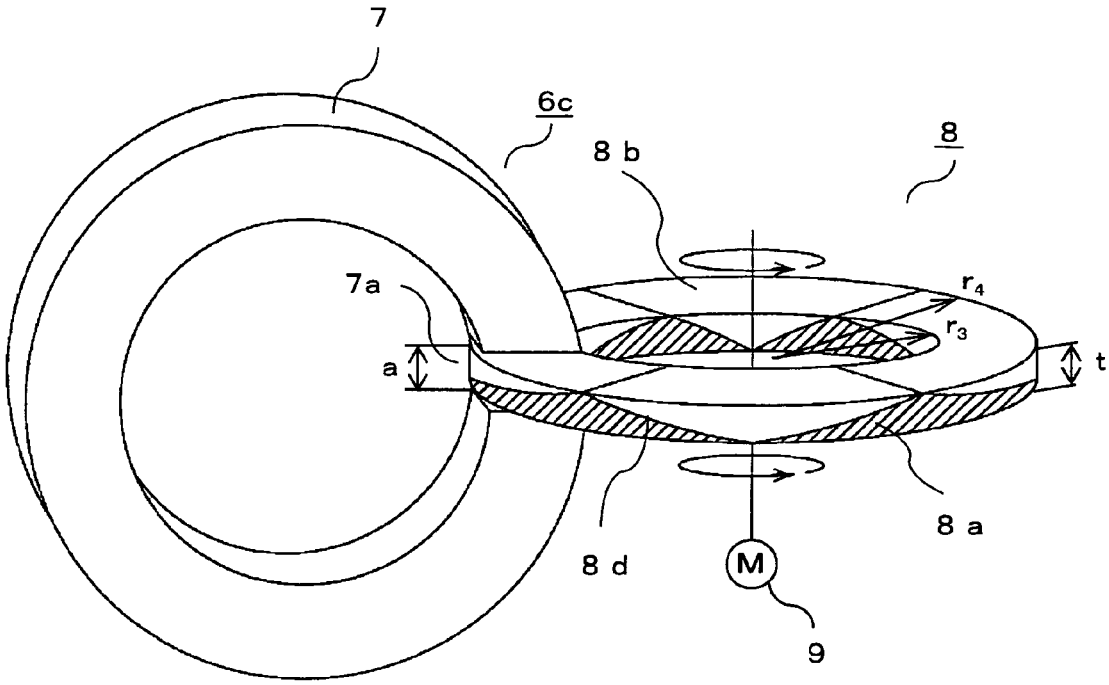
FIG. 6 is a schematic diagram of an inductance varying device according to a third embodiment of the invention.

Now, a third embodiment of the invention is described. If the repetition rate of pulses of the charged particle acceleration frequency of a circular accelerator like an ion synchrotron exceeds 100 Hz, for instance, it is difficult to employ one of the above-described configurations of the first and second embodiments, in which the magnetic pole gap is varied by rotating one of core members, due to limitations on turning speed of the turning mechanism 9. One approach to this problem is to employ an inductance varying device provided with a flat toroidal magnetic member which produces a plurality of changes in reluctance with a single rotation instead of the flat toroidal magnetic member 8 of the first embodiment shown in FIGS. 2A and 2B. FIG. 6 shows an inductance varying device 6*c* including a toroidal core 7, a flat toroidal magnetic member 8 and a turning mechanism 9 according to the third embodiment of the invention based on this approach. The toroidal core 7 of this embodiment is identical to that of the first embodiment shown in FIG. 2A. Also, the flat toroidal magnetic member 8 of this embodiment has the same doughnutlike shape and size as that of the first embodiment shown in FIGS. 2A and 2B with the inner radius $r_3$, the outer radius $r_4$ and thickness t as a whole. What is characteristic of the third embodiment is that the flat toroidal magnetic member 8 is made up of a plurality of toroidal magnetic elements 8*a* made of a magnetic material, such as ferrite, and a plurality of toroidal nonmagnetic elements 8*b* made of a ceramic material, which are alternately arranged and bonded on facing surfaces 8*d* thereof to together form the doughnutlike shape, the successive toroidal magnetic elements 8*a* and the successive toroidal nonmagnetic elements 8*b* together forming a sawtoothed cross-sectional pattern along the circumference of the doughnutlike shape. While the facing surfaces 8*d* of the toroidal magnetic elements 8*a* and the toroidal nonmagnetic elements 8*b* form the sawtoothed cross-sectional pattern having four "teeth" (notched projections in cross section) along the circumference of the toroidal magnetic member 8 as can be seen from the illustrated example of FIG. 6, the number of teeth of this sawtoothed cross-sectional pattern is not limited to four.

By turning the flat toroidal magnetic member 8 with the turning mechanism 9 of the inductance varying device 6*c* thus structured, it is possible to tune an accelerating cavity unit 50 to obtain the same reluctance changing pattern (inductance changing pattern) as a changing pattern of the acceleration frequency, or acceleration frequency changing pattern, of a circular accelerator.

Fourth Embodiment

A fourth embodiment of the invention is now described with reference to FIG. 7 which is a schematic diagram of an inductance varying device 6*d* according to the fourth embodiment. The inductance varying device 6*d* of this embodiment is characterized in that it employs a rotatable multipolar toroidal core member 11 instead of the rotatable semicircular toroidal core member 11 of the above-described inductance varying device 6*a* of the second embodiment illustrated in FIG. 4.

Figure 7:
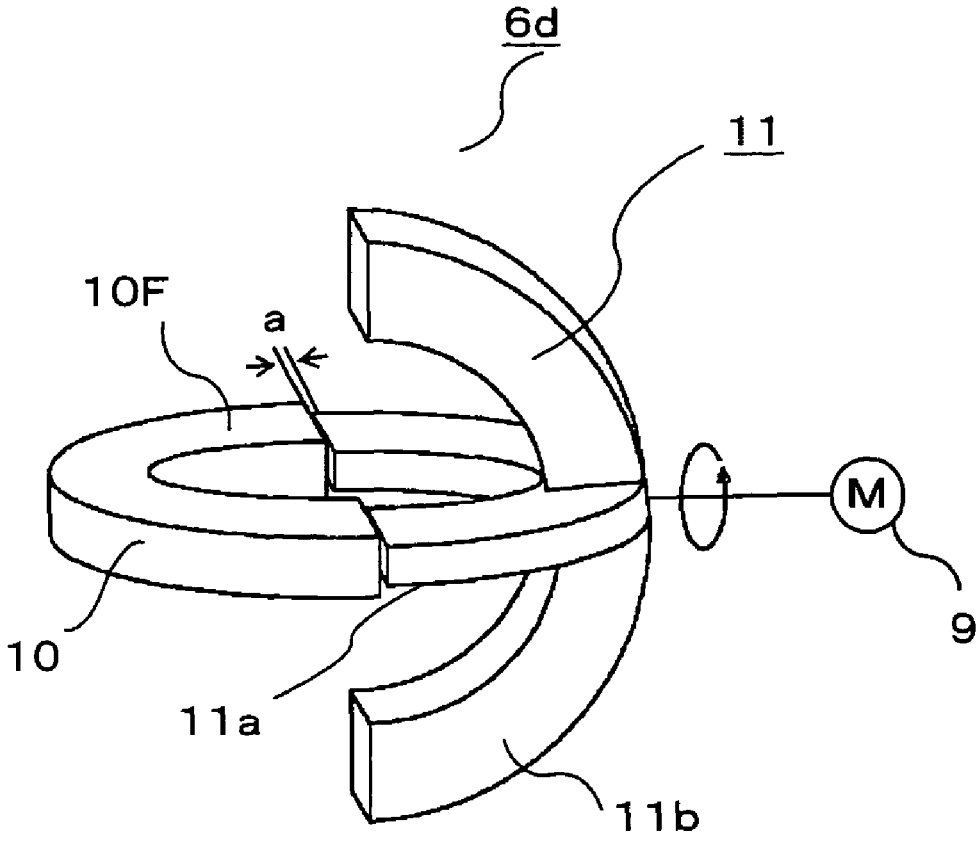
FIG. 7 is a schematic diagram of an inductance varying device according to a fourth embodiment of the invention.

Referring to FIG. 7, the rotatable multipolar toroidal core member 11 includes a pair of rotatable semicircular toroidal core segments 11*a*, 11*b* obtained by splitting a doughnut-shaped core into two halves, the two rotatable semicircular toroidal core segments 11*a*, 11*b* being joined together by bonding in a form resembling a cross as illustrated. In this embodiment, an inductance changing pattern matching a corresponding acceleration frequency changing pattern can be obtained more easily by turning the rotatable multipolar toroidal core member 11 thus structured by a turning mechanism 9 of the inductance varying device 6*d*. If fine adjustment of the inductance changing pattern is necessary, magnetic poles of a stationary core member 10 should be reshaped by mounting a magnetic pole shim on each end face 10F of the stationary core member 10, for instance.

Fifth Embodiment

Figure 8A:
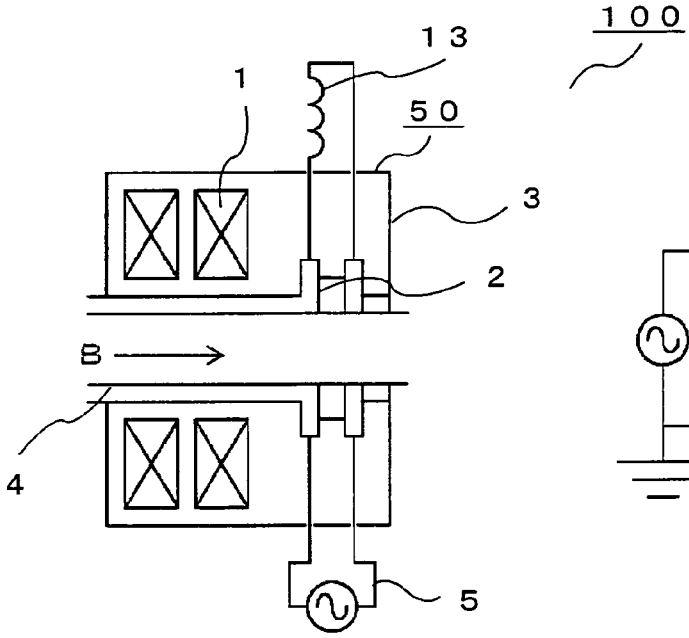
FIGS. 8A and 8B are a schematic diagram and an equivalent circuit showing the structure of an RF accelerating cavity according to a fifth embodiment of the invention.
Figure 8B:
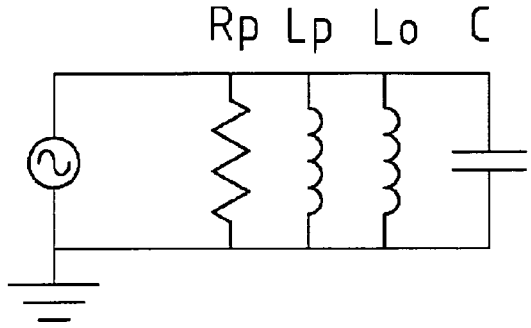

An RF accelerating cavity 100 according to a fifth embodiment of the invention is now described with reference to FIGS. 8A and 8B. As shown in these Figures, the RF accelerating cavity 100 of this embodiment is characterized in that a fixed inductance 13 which serves as an inductance varying device is connected parallel to an acceleration electrode gap 2 in the form of an external core attached to an accelerating cavity unit 50. This structure of the embodiment is advantageous under conditions where:

1. It is desired to produce high exciting magnetic flux due to the need for a high accelerating voltage, and it is necessary to employ an acceleration core having a high saturated magnetic field density to produce an increased magnetic flux density due to limitations on installation space of the acceleration core; and
2. The RF accelerating cavity 100 has a narrow acceleration frequency range and a permissible range of its Q-value is approximately 3 to 9.

The earlier-described accelerating cavity structure of Japanese Laid-open Patent Application No. 2001-126900 is such that a gap is formed in an acceleration core, inductance of the acceleration core is lowered by adjusting gap length, shunt impedance of the acceleration core at a particular resonant frequency is increased, and the Q-value is adjusted in order to configure an RF accelerating cavity which satisfies the aforementioned conditions.

The fifth embodiment of the invention is intended to provide a solution to the earlier-mentioned problems of Japanese Laid-open Patent Application No. 2001-126900. Specifically, the RF accelerating cavity 100 provided with the fixed inductance 13 connected parallel to the acceleration electrode gap 2 as depicted in FIG. 8A exerts the same advantageous effect as obtained by making a gap in an acceleration core 1. As the provision of the fixed inductance 13 eliminates the need for forming a gap in the acceleration core 1 or providing a variable inductance, the RF accelerating cavity 100 of the present embodiment can be produced at low cost.

Operation of the RF accelerating cavity 100 of the fifth embodiment is now described by using an example of mathematical modeling.

Expressing the impedance of the acceleration core 1 as $Z_1=R_1+iX_1$ and that of the fixed inductance (external core) 13 as $Z_2=R_2+iX_2$, real and imaginary parts of a combined impedance of the parallel-connected two cores 1, 13, or $Z_3=R_3+iX_3$, are written as follows:

$$R_3 = \frac{R_1(R_2^2+X_2^2)+R_2(R_1^2+X_1^2)}{(R_1+R_2)^2+(X_1+X_2)^2} = \frac{R_1|Z_2^2|+R_2|Z_1^2|}{(R_1+R_2)^2+(X_1+X_2)^2} \tag{8a}$$

$$X_3 = \frac{X_1(R_2^2+X_2^2)+X_2(R_1^2+X_1^2)}{(R_1+R_2)^2+(X_1+X_2)^2} = \frac{X_1|Z_2^2|+X_2|Z_1^2|}{(R_1+R_2)^2+(X_1+X_2)^2} \tag{8b}$$

From equations (8a) and (8b) above, $Q=X_3/R_3$ is calculated as follows:

$$Q = \frac{X_3}{R_3} = \frac{X_1|Z_2^2|+X_2|Z_1^2|}{R_1|Z_2^2|+R_2|Z_1^2|} \tag{9}$$

Now, the effect of the fixed inductance (external core) 13 parallel-connected to the acceleration electrode gap 2 are estimated using a typical example of the structure of the fifth embodiment. Assuming that the acceleration core 1 ($Z_1$) employs a magnetic alloy material with $Q_1=0.5$, the external core 13 ($Z_2$) employs ferrite with $Q_2=20$, and an inductance component of the impedance of the external core 13 is one-half that of the acceleration core 1, the Q-value of the combined impedance of the parallel-connected two cores 1, 13 is calculated as follows:

$$R_1=2X_1$$

$$R_2=0.05X_2$$

$$X_2=0.5X_1$$

$$R_3=0.099X_1$$

$$X_3=0.43X_1$$

$$Q=X_3/R_3=4.4 \tag{10}$$

For evaluating the effect of the additional provision of the fixed inductance 13 parallel-connected to the acceleration electrode gap 2, it is convenient to transform each impedance into a parallel connection format. Thus, transforming the impedances of the acceleration core 1 alone ($Z_1$) made of the magnetic alloy material and the aforementioned parallel-connected two cores 1, 13 ($Z_3$) by using equations (2a) and (2b)

and substituting equation (10) into results of the transformation, $$Z_{p1}=R_{p1}+iX_{p1} \tag{11a}$$

$$Z_{p3}=R_{p3}+iX_{p3} \tag{11b}$$

where $X_{p1}=5X_1$
$X_{p3}=0.46X_1$
$X_{p3}=0.091X_{p1}$
$R_{p1}=2.5X_1$
$R_{p3}=2X_1$
$R_{p3}=0.8R_{p1}$ On the other hand, the inductance of the RF accelerating cavity 100 is uniquely determined by resonant frequency thereof and the capacitance C of the acceleration electrode gap 2. Thus, it is necessary to adjust the RF accelerating cavity 100 such that the inductance remains the same. In this example of the fifth embodiment, the inductance of the RF accelerating cavity 100 is multiplied by a factor of 0.091. Accordingly, the inductance of the RF accelerating cavity 100 is kept unchanged by multiplying core thickness of the fixed inductance (external core) 13 by a factor of 1/0.091, for example. As a result of this adjustment, the shunt impedance is also multiplied by a factor of 1/0.091. After all, impedance $Z'_{p3}$ of the RF accelerating cavity 100 is expressed as follows:

$$Z'_{p3}=R'_{p3}+iX'_{p3} \tag{12}$$

where $X'_{p3}=X_{p1}$
$R'_{p3}=8.8R_{p1}$

It is understood from the foregoing discussion that the shunt impedance increases 8.8 times as high and the Q-value increases from 0.5 to 4.4 with the additional provision of the fixed inductance 13 having a properly selected physical size that is connected parallel to the acceleration electrode gap 2.

This effect of the fifth embodiment is equivalent to the earlier-described effect of making a gap in an acceleration core as recited in Japanese Laid-open Patent Application No. 2001-126900. The structure of the present embodiment is advantageous, however, over that of the Laid-open Patent Application in that the RF accelerating cavity 100 can be manufactured at lower cost as it is not necessary to cut the core for making a gap.

Sixth Embodiment

An inductance varying device 6*e* of an RF accelerating cavity 100 according to a sixth embodiment of the invention is now described with reference to FIGS. 9A and 9B. While the foregoing first to fifth embodiments deal with structures for mechanically varying inductance, this embodiment provides a structure for electrically varying inductance.

Figure 9A:
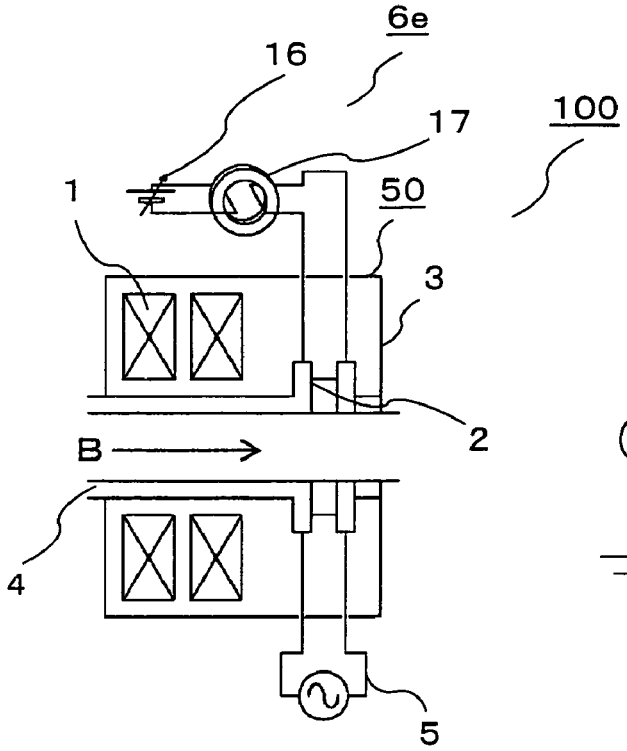
FIGS. 9A and 9B are a schematic diagram and an equivalent circuit showing the structure of an RF accelerating cavity according to a sixth embodiment of the invention.
Figure 9B:
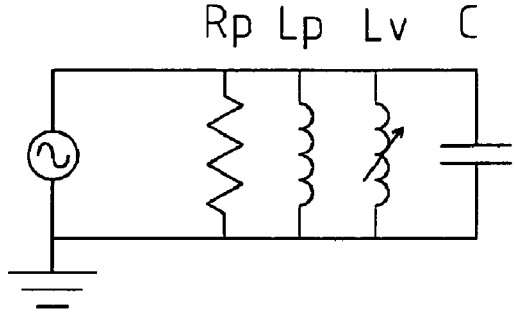

Referring to FIG. 9A, the RF accelerating cavity 100 includes in addition to the aforementioned inductance varying device 6*e* an external cavity core 17 having a toroidal shape, for instance, which is provided on the outside of an accelerating cavity unit 50 and connected parallel to an acceleration electrode gap 2, and a variable constant current power supply 16 for supplying a constant current which is linked to the cavity core 17. In order to vary the inductance of the cavity core 17, the variable constant current power supply 16 is switched on and off in accordance with a changing pattern of an acceleration frequency for accelerating a charged particle beam.

As previously mentioned with reference to the first embodiment, characteristics of ferrite are thermally unstable, so that adjustment of inductance thereof by use of a biasing current is generally difficult. However, the cavity core 17 of this embodiment shown in FIG. 9A which corresponds to an external inductance need not surround an outside cavity wall 3 and is free from limitations of size and installation site selection, so that a cooling system for the cavity core 17 can be easily designed and built. For example, one simple configuration of a cooling system for improving thermal stability of the cavity core 17 is to cool a core body of the cavity core 17 in a liquid cooling medium.

In a case where an acceleration core 1 employs a core body having a low Q-value (e.g., Q=0.5), the RF accelerating cavity 100 has a Q-value of about 4.4 in its entirety as shown in equation (10) and thereby exhibits reduced sharpness of resonance even when low-loss ferrite having a Q-value of 20 is selected for the core body of the cavity core 17. This means that it is possible to significantly decrease instability of resonance of the structure of the sixth embodiment if ferrite having low power loss (high Q-value) is used in the cavity core 17 to suppress heat generation and temperature changes thereof to achieve improved stability of resonance as a result of a reduction in the sharpness of resonance.

The above-described arrangement of the sixth embodiment to select materials of the acceleration core 1 and the external cavity core inductance varying device) 17 such that the Q-value ($\mu_p Qf$) of the former differs from (is lower than) the Q-value of the magnetic material of the latter will exert a greater advantageous effect when applied to the foregoing first to fifth embodiments or to a below-described seventh embodiment.

Seventh Embodiment

An RF accelerating cavity 100 according to the seventh embodiment of the invention is described below with reference to FIG. 10. The RF accelerating cavity 100 of this embodiment employs an inductance varying device 6*f* which generally tunes the RF accelerating cavity 100 by varying inductance thereof in a steplike fashion. Generally, an RF accelerating cavity having a Q-value of up to about 5 maintains an impedance about 90% that at a resonance point within a range of f±0.25 MHz, where f is a resonant frequency which is assumed to be a few megahertz. On the other hand, an acceleration frequency of an ordinary accelerator can vary over a range of about 1 to 5 MHz. In a case where the range of acceleration frequency changes of the accelerator is 5 MHz, for example, the accelerator maintains an impedance which is 90% that in a continuously tuned condition if the inductance is varied 10 times in discrete steps.

Figure 10:
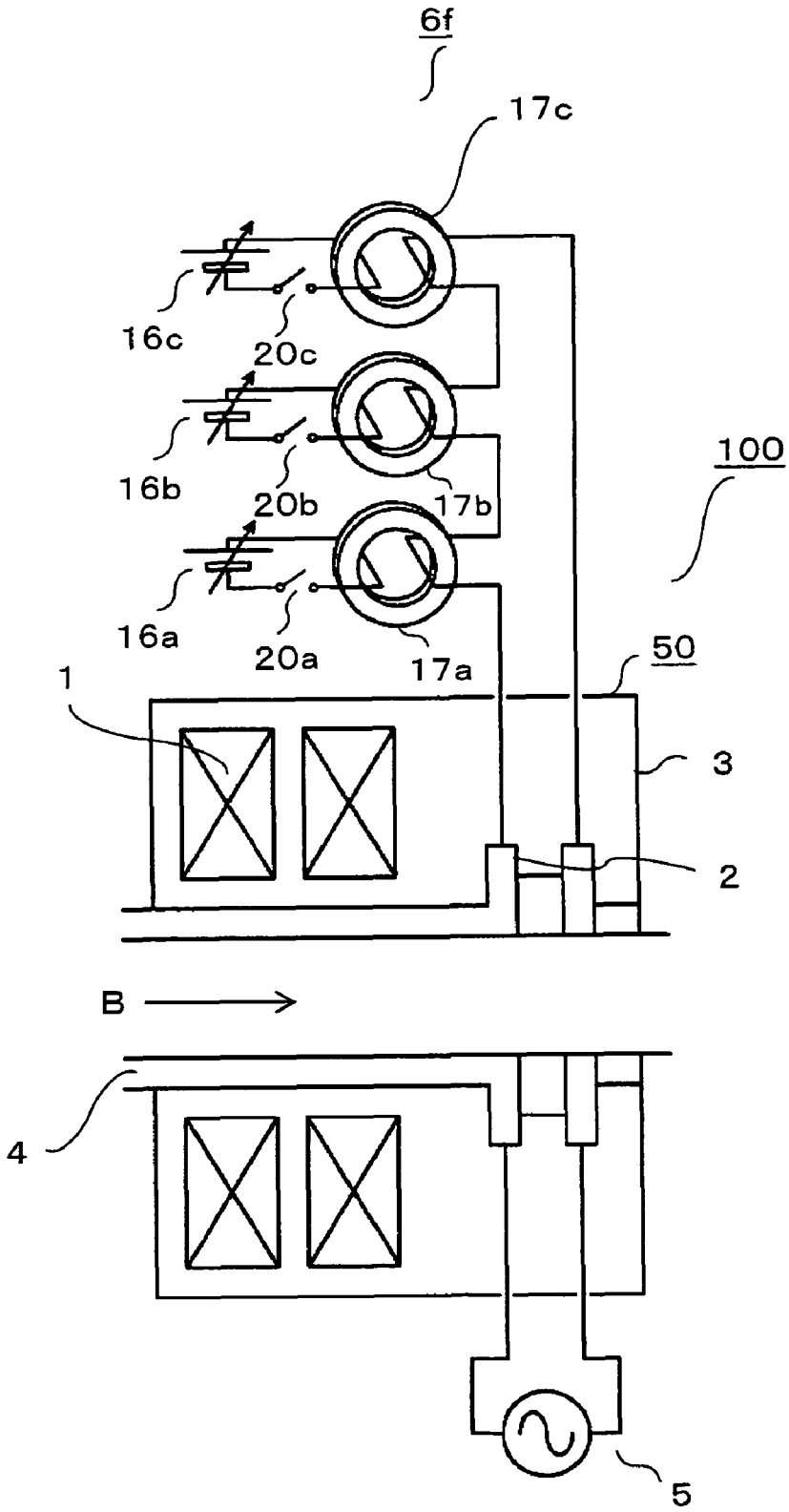
FIG. 10 is a schematic diagram showing the structure of an RF accelerating cavity according to a seventh embodiment of the invention.

Referring to FIG. 10, a structure for varying the inductance of the RF accelerating cavity 100 of the seventh embodiment is described. As depicted in FIG. 10, the RF accelerating cavity 100 includes in addition to the aforementioned inductance varying device 6*f* three external cavity cores 17*a*, 17*b*, 17*c* constituting external inductances which are connected parallel to an acceleration electrode gap 2, as well as variable constant current power supplies 16*a*, 16*b*, 16*c* and switches 20*a*, 20*b*, 20*c* which are connected in series to the respective cavity cores 17*a*, 17*b*, 17*c*. The RF accelerating cavity 100 is configured such that the switches 20*a*, 20*b*, 20*c* are turned on and off in accordance with an acceleration frequency changing pattern, whereby biasing currents flow wires (coils) wound around the respective cavity cores 17*a*, 17*b*, 17*c*. The biasing currents are switched between two alternative modes only, that is, on and off modes. When the biasing currents are in the on mode, the cavity cores (external inductances) 17*a*, 17*b*, 17*c* saturate and permeability thereof takes a value nearly equal to 1.

With this structure of the embodiment, the number of external inductances (cavity cores) connected to the acceleration electrode gap 2 can be changed to 1, 2 or 3 so that the value of a total external inductance can be varied up to three times. While the number of the externally connected cavity cores is 3 in the above-described example of the embodiment, the invention is not thereto.

Figure 11:
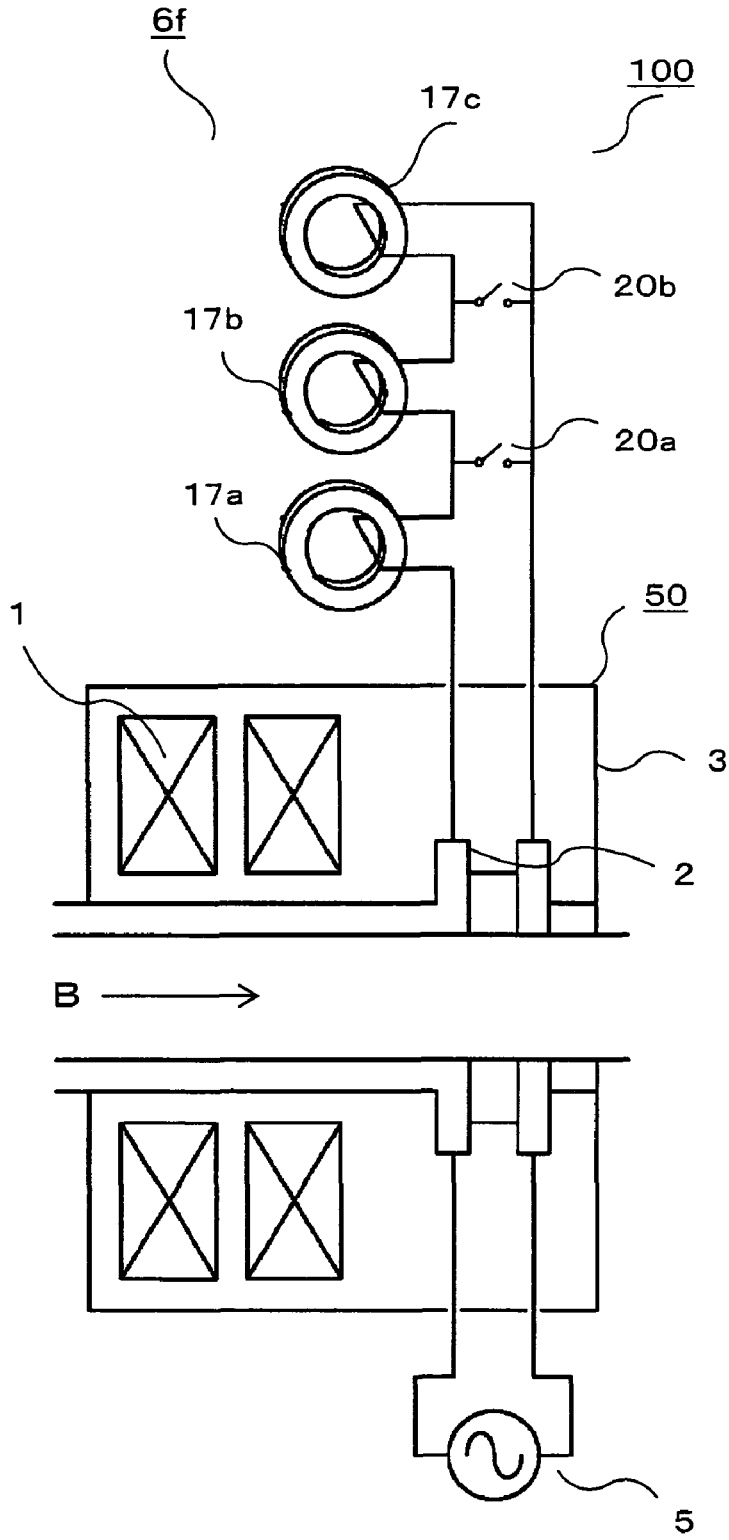
FIG. 11 is a schematic diagram showing the structure of an RF accelerating cavity in one variation of the seventh embodiment.

FIG. 11 is a schematic diagram showing one variation of the seventh embodiment, in which the three cavity cores (external inductances) 17*a*, 17*b*, 17*c* are arranged in a series and this combination of the external inductances is simply connected parallel to the acceleration electrode gap 2, two switches 20*a*, 20*b* are provided at points in a circuit between any two adjacent ones of the cavity cores (17*a* and 17*b*, and 17*b* and 17*c* as illustrated in FIG. 11), and these switches 20*a*, 20*b* are turned on or off by a signal fed from a control device (not shown).

Eighth Embodiment

While inductance for tuning an RF accelerating cavity connected parallel to a gap formed in a cavity core is variable inductance as discussed in the foregoing embodiments, the invention is not limited thereto. If fixed inductance is used for cavity tuning, for instance, it is possible to narrow the acceleration frequency range of the RF accelerating cavity and alter the same to a type having a high-impedance characteristic. This means that the Q-value of the RF accelerating cavity can be arbitrarily varied by adjusting parallel-connected the fixed inductance for the same purpose as the earlier-mentioned Japanese Laid-open Patent Application No. 2001-126900. This approach, or an eighth embodiment of the invention, makes it possible to regulate the Q-value at low cost without the need for core cutting or a gap adjusting mechanism.

Ninth Embodiment

When any of the RF accelerating cavities 100 of the foregoing first to eighth embodiments is adopted in a circular accelerator which accelerates a charged particle beam and accumulates accelerated electrically charged particles where necessary, the RF accelerating cavity 100 can be easily tuned such that an acceleration frequency of the RF accelerating cavity 100 matches a resonant frequency thereof by simple control. This approach, or a ninth embodiment of the invention, exerts a variety of notable advantages, such as an increase in accelerating voltage, stability of acceleration, increases in accelerating energy and beam current, and a reduction in size of the circular accelerator.

What is claimed is:

1. An RF accelerating cavity for use in a circular accelerator which accelerates a charged particle beam and accumulates accelerated electrically charged particles where necessary, said RF accelerating cavity comprising:

an accelerating cavity unit including an acceleration electrode gap for generating an RF electric field for accelerating the charged particle beam and an acceleration core forming a magnetic path surrounding an orbit of the charged particle beam; and an inductance varying device of which magnetic member is connected parallel to said acceleration electrode gap;

wherein inductance produced by said inductance varying device is varied in accordance with a changing pattern of a charged particle beam acceleration frequency to tune said RF accelerating cavity such that the charged particle beam acceleration frequency matches a resonant frequency of said RF accelerating cavity;

said inductance varying device including:

a toroidal core in which a radially cut gap is formed;

a rotatable flat toroidal magnetic member disposed in a plane perpendicular to said toroidal core, a central axis of rotation of said flat toroidal magnetic member being located at a position separated outward from an outer periphery of said toroidal core, and a turning mechanism for turning said flat toroidal magnetic member;

wherein said turning mechanism turns said flat toroidal magnetic member in accordance with the changing pattern of the charged particle beam acceleration frequency to cause said flat toroidal magnetic member to turn through the gap formed in said toroidal core, thereby varying the inductance produced by said inductance varying device, such that the charged particle beam acceleration frequency matches the resonant frequency of said RF accelerating cavity.

2. The RF accelerating cavity according to claim 1, wherein said flat toroidal magnetic member includes a toroidal magnetic element and a toroidal nonmagnetic element, each having a tapered facing surface which is inclined by a specific angle with respect to the plane in which said flat toroidal magnetic member lies, and wherein said toroidal magnetic element and said toroidal nonmagnetic element are bonded to each other on the tapered facing surfaces thereof, together forming a single structure.

3. The RF accelerating cavity according to claim 1, wherein said flat toroidal magnetic member includes a plurality of toroidal magnetic elements and a plurality of toroidal nonmagnetic elements which are alternately arranged and bonded on facing surfaces thereof to together form a doughnutlike shape, the successive toroidal magnetic elements and the successive toroidal nonmagnetic elements together forming a sawtoothed cross-sectional pattern along the circumference of the doughnutlike shape with notched projections and recesses of the sawtoothed cross-sectional pattern formed by the successive toroidal magnetic elements engaged respectively with notched recesses and projections of the sawtoothed cross-sectional pattern formed by the successive toroidal nonmagnetic elements at regular intervals along the circumference of said flat toroidal magnetic member.

4. An RF accelerating cavity for use in a circular accelerator which accelerates a charged particle beam and accumulates accelerated electrically charged particles where necessary, said RF accelerating cavity comprising:

an accelerating cavity unit including an acceleration electrode gap for generating an RF electric field for accelerating the charged particle beam and an acceleration core forming a magnetic path surrounding an orbit of the charged particle beam; and an inductance varying device of which magnetic member is connected parallel to said acceleration electrode gap;

wherein inductance produced by said inductance varying device is varied in accordance with a changing pattern of a charged particle beam acceleration frequency to tune said RF accelerating cavity such that the charged particle beam acceleration frequency matches a resonant frequency of said RF accelerating cavity;

said inductance varying device including:

a stationary semicircular toroidal core member;

a rotatable semicircular toroidal core member disposed rotatably on an axis commonly shared with said stationary semicircular toroidal core member with a specific gap length held between said two core members; and a turning mechanism for turning said rotatable semicircular toroidal core member;

wherein said turning mechanism turns said rotatable semicircular toroidal core member in accordance with a changing pattern of a charged particle beam acceleration frequency to tune said RF accelerating cavity by varying inductance produced by said inductance varying device such that the charged particle beam acceleration frequency matches the resonant frequency of said RF accelerating cavity.

5. The RF accelerating cavity according to claim 4, wherein said rotatable semicircular toroidal core member is provided with a hemispherical weight balancer made of a nonmagnetic material entirely covering said rotatable semicircular toroidal core member.

6. An RF accelerating cavity for use in a circular accelerator which accelerates a charged particle beam and accumulates accelerated electrically charged particles where necessary, said RF accelerating cavity comprising:

an accelerating cavity unit including an acceleration electrode gap for generating an RF electric field for accelerating the charged particle beam and an acceleration core forming a magnetic path surrounding an orbit of the charged particle beam; and an inductance varying device of which magnetic member is connected parallel to said acceleration electrode gap;

wherein inductance produced by said inductance varying device is varied in accordance with a changing pattern of a charged particle beam acceleration frequency to tune said RF accelerating cavity such that the charged particle beam acceleration frequency matches a resonant frequency of said RF accelerating cavity;

said inductance varying device including:

a stationary semicircular toroidal core member;

a rotatable multipolar toroidal core member disposed rotatably on an axis commonly shared with said stationary semicircular toroidal core member with a specific gap length held between said two core members, said rotatable multipolar toroidal core member being made up of two rotatable semicircular toroidal core segments which are joined together at right angles to each other; and a turning mechanism for turning said rotatable multipolar toroidal core member;

wherein said turning mechanism turns said rotatable multipolar semicircular toroidal core member in accordance with the changing pattern of the charged particle beam acceleration frequency to tune said RF accelerating cavity by varying inductance produced by said inductance varying device such that the charged particle beam acceleration frequency matches the resonant frequency of said RF accelerating cavity.

7. An RF accelerating cavity for use in a circular accelerator which accelerates a charged particle beam and accumulates accelerated electrically charged particles where necessary, said RF accelerating cavity comprising:

an accelerating cavity unit including an acceleration electrode gap for generating an RF electric field for accelerating the charged particle beam and an acceleration core forming a magnetic path surrounding an orbit of the charged particle beam; and a fixed inductance connected parallel to said acceleration electrode gap;

wherein said RF accelerating cavity is tuned by properly selecting the physical size of said fixed inductance such that a charged particle beam acceleration frequency matches a resonant frequency of said RF accelerating cavity; and wherein a material of said acceleration core has a $\mu_p$Qf-value differing from that of a magnetic material of said fixed inductance, the $\mu_p$Qf-value of said acceleration core being lower than the $\mu_p$Qf-value of said fixed inductance.

8. A circular accelerator for accelerating a charged particle beam and accumulating accelerated electrically charged particles where necessary, said circular accelerator comprising an RF accelerating cavity according to claim 7.

9. An RF accelerating cavity for use in a circular accelerator which accelerates a charged particle beam and accumulates accelerated electrically charged particles where necessary, said RF accelerating cavity comprising:

an accelerating cavity unit including an acceleration electrode gap for generating an RF electric field for accelerating the charged particle beam and an acceleration core forming a magnetic path surrounding an orbit of the charged particle beam; and an inductance varying device of which magnetic member is connected parallel to said acceleration electrode gap;

wherein inductance produced by said inductance varying device is varied in accordance with a changing pattern of a charged particle beam acceleration frequency to tune said RF accelerating cavity such that the charged particle beam acceleration frequency matches a resonant frequency of said RF accelerating cavity;

said inductance varying device including:

a cavity core; and a current power supply;

wherein said current power supply feeds a current for producing a biasing magnetic field which is applied to said cavity core in accordance with the changing pattern of the charged particle beam acceleration frequency to vary the inductance produced by said inductance varying device such that the charged particle beam acceleration frequency matches the resonant frequency of said RF accelerating cavity.

10. An RF accelerating cavity for use in a circular accelerator which accelerates a charged particle beam and accumulates accelerated electrically charged particles where necessary, said RF accelerating cavity comprising:

an accelerating cavity unit including an acceleration electrode gap for generating an RF electric field for accelerating the charged particle beam and an acceleration core forming a magnetic path surrounding an orbit of the charged particle beam; and an inductance varying device of which magnetic member is connected parallel to said acceleration electrode gap;

wherein inductance produced by said inductance varying device is varied in accordance with a changing pattern of a charged particle beam acceleration frequency to tune said RF accelerating cavity such that the charged particle beam acceleration frequency matches a resonant frequency of said RF accelerating cavity;

said inductance varying device including:

a plurality of cavity cores arranged in a series;

a plurality of current power supplies provided for said individual cavity cores; and a plurality of switches connected to said individual current power supplies;

wherein said individual switches are controllably turned on to feed currents for producing biasing magnetic fields which are applied to said cavity cores in accordance with the changing pattern of the charged particle beam acceleration frequency to vary the inductance produced by said inductance varying device such that the charged particle beam acceleration frequency matches the resonant frequency of said RF accelerating cavity.

11. An RF accelerating cavity for use in a circular accelerator which accelerates a charged particle beam and accumulates accelerated electrically charged particles where necessary, said RF accelerating cavity comprising:

an accelerating cavity unit including an acceleration electrode gap for generating an RF electric field for accelerating the charged particle beam and an acceleration core forming a magnetic path surrounding an orbit of the charged particle beam; and an inductance varying device of which magnetic member is connected parallel to said acceleration electrode gap;

wherein inductance produced by said inductance varying device is varied in accordance with a changing pattern of a charged particle beam acceleration frequency to tune said RF accelerating cavity such that the charged particle beam acceleration frequency matches a resonant frequency of said RF accelerating cavity:

said inductance varying device including:

a plurality of cavity cores arranged in a series; and a switch provided at a point in a circuit between any two adjacent ones of said cavity cores;

wherein said switch is controllably turned on in accordance with the changing pattern of the charged particle beam acceleration frequency to vary the inductance produced by said inductance varying device such that the charged particle beam acceleration frequency matches the resonant frequency of said RF accelerating cavity.

12. An RF accelerating cavity for use in a circular accelerator which accelerates a charged particle beam and accumulates accelerated electrically charged particles where necessary, said RF accelerating cavity comprising:

an accelerating cavity unit including an acceleration electrode gap for generating an RF electric field for accelerating the charged particle beam and an acceleration core forming a magnetic path surrounding an orbit of the charged particle beam; and an inductance varying device of which magnetic member is connected parallel to said acceleration electrode gap;

wherein inductance produced by said inductance varying device is varied in accordance with a changing pattern of a charged particle beam acceleration frequency to tune said RF accelerating cavity such that the charged particle beam acceleration frequency matches a resonant frequency of said RF accelerating cavity;

wherein a material of said acceleration core has a $\mu_p$Qf-value differing from that of a magnetic material of said inductance varying device, the $\mu_p$Qf-value of said acceleration core being lower than the $\mu_p$Qf-value of said inductance varying device.

13. An RF accelerating cavity for use in a circular accelerator which accelerates a charged particle beam and accumulates accelerated electrically charged particles where necessary, said RF accelerating cavity comprising:

an accelerating cavity unit including an acceleration electrode gap for generating an RF electric field for accelerating the charged particle beam and an acceleration core forming a magnetic path surrounding an orbit of the charged particle beam;

an inductance connected parallel to said acceleration electrode gap; and an electrode plate inserted in the acceleration electrode gap for dividing a capacitance into a plurality of capacitances and an inductance varying device connected parallel to at least one of the plurality of capacitances.

14. A circular accelerator for accelerating a charged particle beam and accumulating accelerated electrically charged particles where necessary, said circular accelerator comprising an RF accelerating cavity according to claim 13.

15. The RF accelerating cavity according to claim 13, wherein said inductance is an inductance varying device of which magnetic member is connected parallel to said acceleration electrode gap; and wherein inductance produced by said inductance varying device is varied in accordance with a changing pattern of a charged particle beam acceleration frequency to tune said RF accelerating cavity such that the charged particle beam acceleration frequency matches a resonant frequency of said RF accelerating cavity.

* * * * *